US007000553B1

(12) United States Patent
Wang

(10) Patent No.: US 7,000,553 B1
(45) Date of Patent: Feb. 21, 2006

(54) METHOD FOR MANUFACTURING HEADGEAR OF A PEELING OFF EFFECT

(76) Inventor: Tai-Kuang Wang, PO Box 82-144, Taipei (TW)

( * ) Notice: Subject to any disclaimer, the term of this patent is extended or adjusted under 35 U.S.C. 154(b) by 0 days.

(21) Appl. No.: 11/020,362

(22) Filed: Dec. 27, 2004

(51) Int. Cl.
*D05B 97/00* (2006.01)
*A42B 1/04* (2006.01)

(52) U.S. Cl. ..... 112/475.11; 2/195.1; 2/200.3

(58) Field of Classification Search ..... 112/475.11, 112/475.08, 475.09, 475.01, 475.04; 2/200.3, 2/195.1, 175.1
See application file for complete search history.

(56) References Cited

U.S. PATENT DOCUMENTS 4,270,229 A * 6/1981 Lipschutz ..... 2/195.1
4,620,325 A * 11/1986 Hatfield ..... 2/195.1
6,158,055 A * 12/2000 Park ..... 2/195.1

* cited by examiner

*Primary Examiner*—Peter Nerbun
(74) *Attorney, Agent, or Firm*—Leong C. Lei

(57) ABSTRACT

A method of manufacturing headgear of a peeling off effect adopts papers in the headgear manufacture, i.e. pluralities of laminated papers are combined with a fabric, and then integrally colored, cut and sewn to form a headgear. After a wash treatment, the paper material of the headgear will gradually peel off to engender a cracked effect of different degrees on the appearance depending the length of the use time, thereby obtaining an ancient, pioneering and special style.

2 Claims, 2 Drawing Sheets

METHOD FOR MANUFACTURING HEADGEAR OF A PEELING OFF EFFECT

BACKGROUND OF THE INVENTION (a) Technical Field of the Invention

The present invention relates to a method for manufacturing headgear of a peeling off effect. During use, the appearance of the headgear will, as expected, gradually experience a peeling off effect after constant use, wash and artificial tear, thereby obtaining an ancient taste, or even a new fashion tide having a unique style of classical beauty.

(b) Description of the Prior Art

Headgear has become a common clothing accessory for outdoor activities. The style that a headgear carries is the most important factor when a user chooses a headgear, since one would choose various headgears for use in opportune moments and occasions, and for matching clothing of various styles. As such, various kinds of headgears have been designed and manufactured to satisfy the consumers' needs.

Taking a baseball cap for example, basically, a baseball cap is composed of six pieces sewn together to form a crown shape, and a peak of a hard material sewn to the front end of the crown for the purpose of sunshade. As the outer appearance of the crown is a fabric material, it will not be easily worn out even after constant dirtying and wash. As such, the style of the cap remains unchanged, thus making the user bored with it.

Accordingly, there exists a need for changing the style of the headgear commonly used, while improving the durability of the headgear, and still, allowing the freshness of the headgear. The inventor thus researched and disclosed a headgear which is enriched of variation during the time of constant use.

Concluded above, the invention has provided a novel method for manufacturing a headgear, the appearance of which will gradually peel off after constant use and wash, thus presenting a classical style full of freshness and aesthetics.

SUMMARY OF THE INVENTION

The primary purpose of the present invention is to provide a method for manufacturing a headgear, the appearance of which is made of a laminated paper material, such that after times of use, wash and artificial tear, a peeling off effect will be engendered, thereby obtaining a classical beauty.

The secondary object of the invention is to provide a method for manufacturing a headgear which has a changing appearance in material, thereby keeping a freshness in style.

To obtain the above objects, the invention has adopted a paper material in the headgear manufacture, i.e. adhering a laminated paper material to a fabric, coloring the laminate of paper and fabric, cutting the laminate of paper and fabric into pieces and sewing them to form a headgear, and processing a wash treatment to make the laminated paper material gradually peel off, thus obtaining a cracked effect on the appearance of the headgear pending the length of time in use, thereby accomplishing a classical beauty.

To completely appreciate these and other objects of the present invention as well as the invention itself, all of which will become apparent to those skilled in the art, the following detailed description of the invention and the claims should be read in conjunction with the accompanying drawings.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
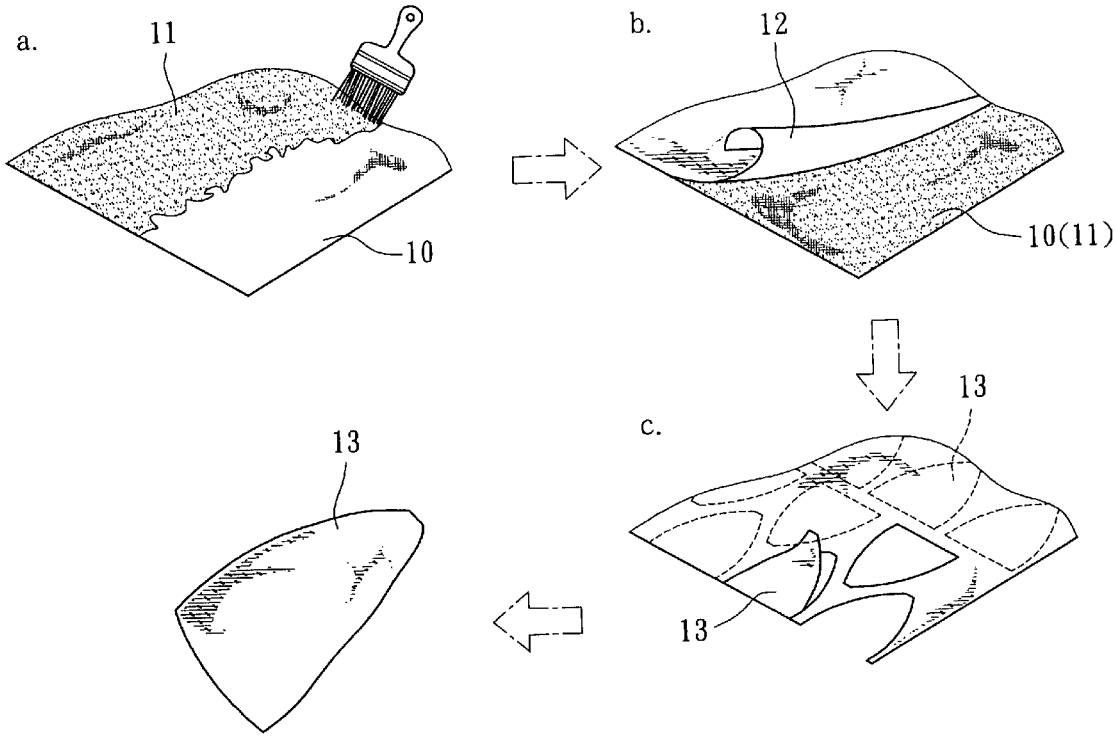
FIG. 1 shows the process of manufacturing according to the present invention.
Figure 2:
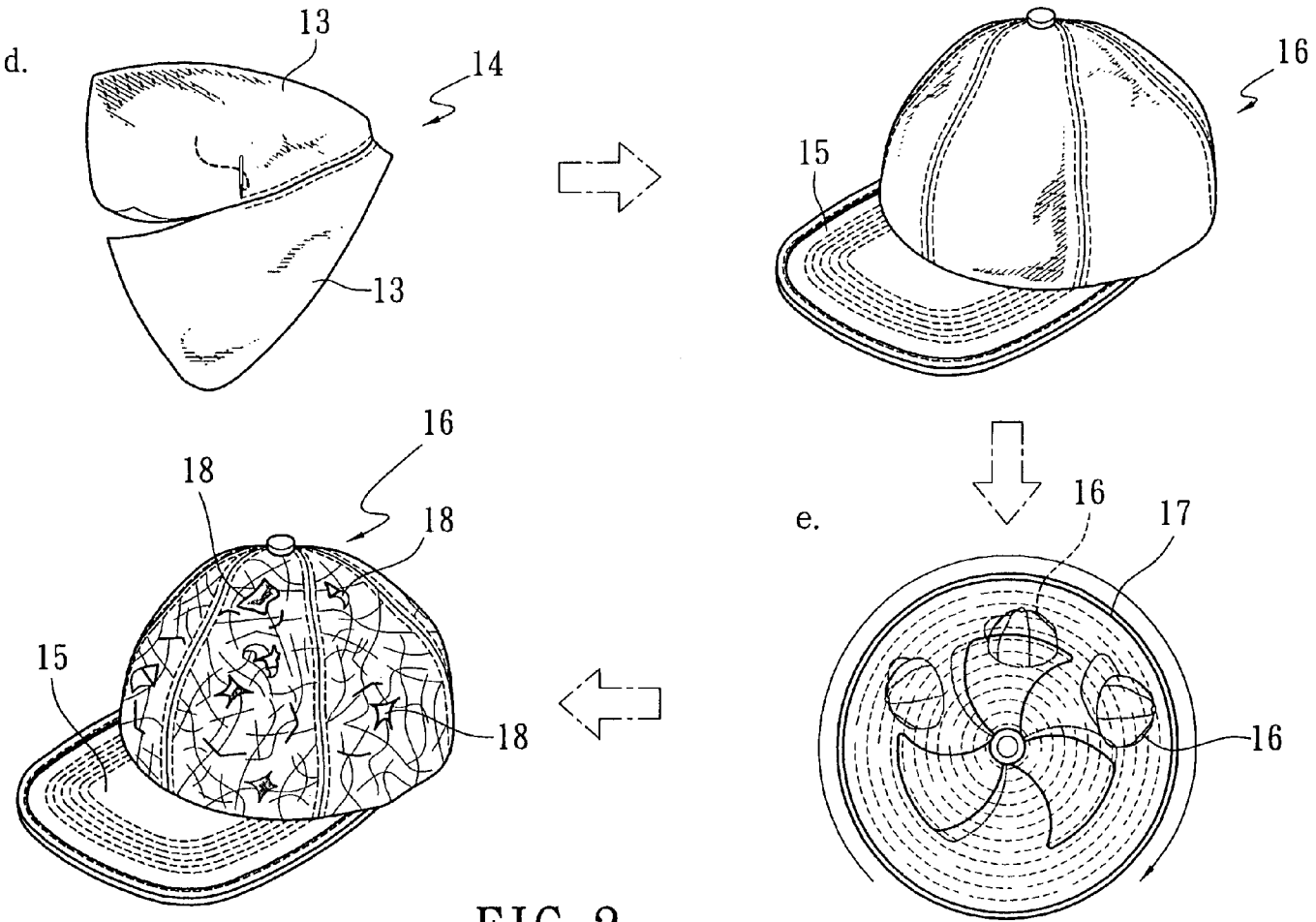
FIG. 2 shows further process of manufacturing according to the present invention.

Referring to FIG. 1, the method of the invention includes the following steps: (step a) applying a layer of adhesive 11 onto a fabric 10 which can optionally be plain or patterned, elastic or non-elastic; (step b) adhering a laminated paper material 12, which can optionally be printing paper, recycled paper, marking paper, wrapping paper, color paper, newsprint, magazine paper, reprocessed paper, kraft paper, wax paper, cotton paper, writing art paper, advertising paper, photo paper, bond paper, cardboard, strawboard, calendar paper, etc., to the adhesive fabric 10, and coloring the laminate of paper and fabric and initiating with material rubbing process, which can alternatively be one or more of the following treatments: wash treatment, pigment spray, dyeing, soaking, hand brushing, dry clean, fluffing, tearing, scratching, peeling, painting, fading, squeezing, folding and pleating, starching, pressing and laminating, such that the crown will present a loosen condition to ease occurring a peeling off effect on the surface after constant wash; and (step c) cutting the processed paper and fabric laminate into pieces 13 of the crown. As shown in FIG. 2, taking a baseball cap as the preferred embodiment of the invention, two ready-cut pieces 13 are sewn together to form a front piece 14 of the crown (step d). The inner side of the front piece 14 is integrally sewn with a lining (not shown). After all the ready-cut pieces 13 are sewn together and further sewn with a peak 15 to form a complete crown 16 shape, a wash-and-rub process (step e) is initiated. As shown in the figure, a washing tank 17 is provided for containing pluralities of headgears 16 for initiating the wash-and-rub process, such that the surface of the headgears 16 can present a deep peeling off effect due to the paper material's being soaked and hard rubbed. The wash-and-rub process can selectively be one or more of the following treatments: one wash, medium wash, heavy wash, enzyme wash, bleach, stone wash, sand blast, chemical spray, halftone dye, dip dye, pigment dye, tea dye, dirty wash, color rubbing, color brush, fluffing, starching, air gun spray, pigment spray, etc. After completion of the above-mentioned wash-and-rub process, the headgear 16 will present a worn out effect 18 on the surface, thereby obtaining a headgear with a peeling off effect.

Concluded the above, the invention discloses a method for manufacturing a headgear having a surface made of a paper material, which will present a peeling off effect after a long term of wash, thereby obtaining a classical beauty and unique style.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method for manufacturing headgear of a peeling off effect, including the following steps:

(a) applying a layer of adhesive on a fabric, and adhering pluralities of laminated papers onto the adhesive fabric;

(b) coloring and rubbing the combined material of fabric and paper;

(c) cutting the combined material of fabric and paper into pieces for preparation of a headgear;

(d) sewing the ready-cut pieces to form a headgear;

(e) and initiating a wash-and-rub process on the headgear to render a peeling off effect on the appearance thereof.

2. The method for manufacturing headgear of a peeling off effect according to claim 1, wherein the rubbing process can alternatively be one or more of the following treatments: wash treatment, pigment spraying, dyeing, soaking, hand brushing, dry clean, peaking, tearing, scratching, peeling, painting, fading, squeezing, folding and pleating, starching, pressing and laminating.

* * * * *